United States Patent [19]

Preuss et al.

[11] Patent Number: 4,991,371

[45] Date of Patent: Feb. 12, 1991

[54] TUBULAR FRAMING BAR, ESPECIALLY A THIN MEMBER FOR FRAMING OF ROOMS OR OPEN SPACES

[76] Inventors: Peter Preuss, Herzog-Johann-Str. 43, 8000, Munich, Fed. Rep. of Germany; Reinhard Schmidek, Pappenheimer-Str. 8, 8701, Eibelstadt, Fed. Rep. of Germany

[21] Appl. No.: 404,497

[22] Filed: Sep. 8, 1989

[30] Foreign Application Priority Data

Sep. 9, 1988 [DE] Fed. Rep. of Germany ..... 3830738

[51] Int. Cl.[5] ..... E04H 12/00

[52] U.S. Cl. ..... 52/648; 403/173; 403/176

[58] Field of Search ..... 403/170, 171, 172, 176; 52/648

[56] References Cited

U.S. PATENT DOCUMENTS

| | | | |
|---|---|---|---|
| 294,344 | 2/1884 | Adams | 403/171 X |
| 2,546,043 | 3/1951 | Parmenter | 403/171 |
| 3,632,147 | 1/1972 | Finger | 403/176 X |

OTHER PUBLICATIONS

John Borrzgo, *Space Grid Structures* "Skeletal Frameworks and Stressed-Skin Systems", 1968, pp. 18–21.

*Primary Examiner*—David A. Scherbel
*Assistant Examiner*—Linda J. Watson
*Attorney, Agent, or Firm*—Laubscher, Presta & Laubscher

[57] ABSTRACT

Tubular bars are connected to form room or open space framing by screw bolts with heads at their ends to connect the bars with intersecting members. Screw bolts with heads are supported in the end areas of the bars to be rotatable and axially movable. Their outward axial movement in each case is limited by a limiting boss in the end area of each bar. The limiting boss for the screw bolts with heads is formed by shaping of the end segments of the tubular bars in their hollow space. In tubular bars with tapered, truncated conical end segments, the head of the screw bolts can be welded against the inside wall of these end segments, when it is of correspondingly fitted truncated conical shape.

11 Claims, 1 Drawing Sheet

TUBULAR FRAMING BAR, ESPECIALLY A THIN MEMBER FOR FRAMING OF ROOMS OR OPEN SPACES

BACKGROUND OF THE INVENTION

The invention relates to a tubular framing bar, especially a thin member for trussing or framing rooms or open spaces, wherein the bars are joined at each of their intersections by screw bolts with heads projecting from the ends of each of the bars, with interposition of intersecting members having suitable threaded boreholes, and the screw bolts with heads are supported in such a manner that they may revolve and move axially in the end areas of the bars, and the outward axial movement of each is limited by a limiting boss located in the end area of each bar.

Tubular framing bars of this sort are known from German Patent No. 874657. The limiting bosses for the screw bolts with heads in these bars are formed by a front plate abutting each hollow conical end member, which also includes the borehole for the passage of the screw shaft. These conical end members are welded onto the frontal areas of each one of the framing bars, which in this case however increases their manufacturing outlay. This same problem also arises with another known tubular framing bar (German Patent No. 2555960), in which socket members are welded into the end areas, through which the screw bolts with heads extend outward with their shafts and of which in each case the inside frontal area forms a limiting boss for a screw bolt with a head.

SUMMARY OF THE INVENTION

A principal object of the invention is to lower the manufacturing outlay for such tubular framing bars.

This object is attained according to the invention in that the limiting boss in the case of the invention is formed by shaping or molding end segments of the tubular bars in their hollow areas. This shaping or molding of the end segments of the bars can be accomplished in various different manners, for instance by rolling, bending inward or rolling inward, as though forming a flange, which in any case is a less costly procedure than the heretofore traditional welding on of additional end segments or welding or soldering of socket members into the ends of the bars. The molded end segments of the tubular bars stiffen and reinforce their ends and furthermore form rigid and substantial limiting bosses for the screw bolts with heads, which in some cases may be transmitting both drive and pressure forces of the traditional order of magnitude. According to the invention, it is preferable to use framing bars with a wall thickness in the range of approximately 1 to 2 mm, which are suitable for the manufacture of relatively lightweight room or space frameworks, for instance for display or exhibition frameworks.

Various different constructions of the invention are possible. For example, the limiting boss in any specific case can be formed with the end segments or the bars somewhat in the shape of a tapered truncated cone, which end segments are embodied in one piece with the cylindrical tubular bodies of the bars. The invention thus can be used extensively, since it is not limited only to framing bars made up of solely cylindrical tubular bodies. The end segments of the bars of truncated conical shape can be manufactured by known metal drawing technology.

There are disclosed herein various embodiments of the limiting boss members according to the invention which securely hold the screw bolts with heads for connection of the bars with the intersecting members of a room or open space framework.

According to still another configuration of the invention, when the head of the screw bolt for connecting the bars with the intersecting members is in the shape of a truncated cone, then its shell surface adapting itself to the inside wall of the truncated conically tapered bar segments can be limited and held in place, and these bar ends form additional limiting bosses for the screw bolts with heads, which limit their outward axial movement together with the limiting bosses formed by shaping the end segments of the tubular bars.

BRIEF DESCRIPTION OF THE DRAWING

The invention is now to be more fully explained relative to the drawings of exemplary embodiments. In the drawing.

DESCRIPTION OF THE PREFERRED EMBODIMENTS

Figure 1:
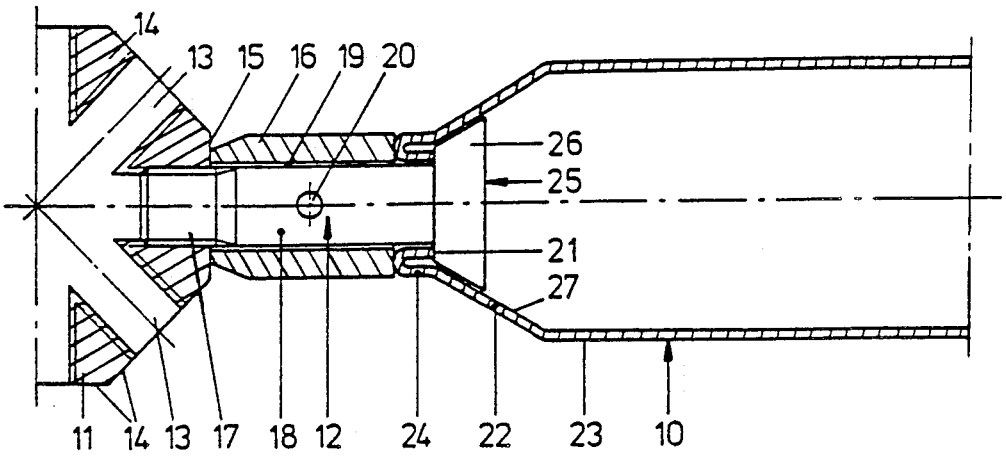
FIG. 1 is an elevational view in section of one conically truncated, tapered end of a tubular framing bar, connected by means of a screw bolt with the head with an intersecting member, of which likewise only a part is shown, and the coupling sleeve inserted between the intersecting member and the end of the bar, to engage with the screw bolt with a head.

FIG. 1 shows the connection of a tubular bar 10 with an intersecting member 11 by means of a screw bolt 12 with a head. In this case, it has to do with parts of a room or open space framework having a plurality of such bars and intersecting members, preferably for use in exhibition stands or the like. Being used for this purpose, bars 10 can be formed of relatively thin metal tubes for instance of steel, having a wall thickness of approximately 1 to 2 mm.

The intersecting member 11 has a plurality of threaded boreholes 13 with their axes intersecting at its middle point, as well as a corresponding number of flattened surfaces 14, which encompass the threaded boreholes 13 around the outside and form contact surfaces for each one of the frontal areas 15 of a coupling sleeve 16 for the screw bolt 12 with a head. Screw bolt 12 with a head is tapped by means of this coupling sleeve with its threaded segment 17 in one of the threaded boreholes 13. For this purpose, screw bolt 12 with a head rests with its shaft 18 axially movable but nonrotatable in the bolt through-hole 19 of coupling sleeve 16. The nonrotatable connection between these parts is obtained by means of a bolt 20 mounted axially transversally to shaft 18 of screw bolt 12 with a head, and the bolt engages with an end projecting from shaft 18 into an oblong axial aperture in the coupling sleeve 16 (not shown).

In the aforementioned assembly, screw bolt 12 with a head is supported axially movably nd rotatably in the end area of bar 10. Its outward axial movement is limited by a limiting boss 21 at the end of bar 10, of which the special configuration according to the invention will be explained hereinafter.

In the exemplary embodiment of FIG. 1, tubular bar 10 has tapered truncated conical end segments 22, which are produced by drawing out a portion of the cylindrical tubular member 23. Each tapered truncated conical end segment 22 of bar 10 has a cylindrical segment 24 at the outside end which is bent back at an angle of 180 degrees back into the hollow space of bar 10 so as to form the limiting boss 21 to engage with the screw bolt 12 with a head.

As shown in FIG. 1, head 25 of screw bolt 12 is embodied in the form of a truncated cone, and the arrangement is displayed so that its shell surface 26 when the connection is completed, as shown in FIG. 1, engages with its entire surface on the inside wall 27 of tapered truncated conical end segment 22. Inside wall 27 thereby forms an additional abutment surface for screw bolt 12, which also limits its axial outward movement. To complete the concept, it is to be noted that the connection shown in FIG. 1 for one end of bar 10 is embodied with an intersecting member 11 at the other end of bar 10 in a mirror image of the other end. When the connection is completed, coupling sleeve 16 is clamped in between intersecting member 11 and the end of the bar.

In the exemplary embodiments shown in FIGS. 2 to 7, identical parts are indicated with the same references as in FIG. 1. However, screw bolt 12 with a head in the form of a cylindrical head 28 to tubular framing bars 10*a* and 10*d* are shown as cylindrical from one end to the other in the embodiments of FIGS. 2 to 5, respectively, and in these cases their outside diameters correspond approximately to that of the coupling sleeve 16. The other ends (not shown) of bars 10*a* to 10*f* are configured in a mirror image of the ends shown in FIGS. 2 to 7.

Figure 2:
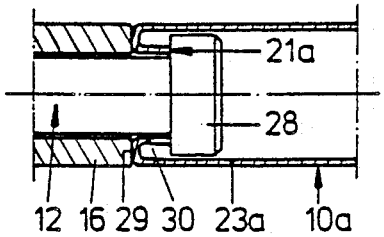
FIGS. 2 through 5 are partial elevational views in section through one end of a cylindrical framing bar, fitted with a part of a screw bolt with a head, a coupling sleeve, and limiting bosses of different configurations according to the invention.

In the exemplary embodiment of FIG. 2, the limiting boss 21*a* to limit the movement of screw bolt 12 with a head has a collar 29 in the shape of a perforated disk, bent inward at a right angle from the cylindrical tubular member 23*a*, to which is joined a socket member 30, extending to the inside of bar 10*a*, which is arranged to be coaxial with the axis of bar 10*a*. The inward directed front edge of this socket member 30 rests in contact with the head 28 of screw bolt 12. Collar 19 in the shape of a perforated disk with the tip-stretched socket member 30 could be produced by means of suitable follow-on tools by a cold deformation process, which of course would also suffice for the other exemplary embodiments.

The limiting boss 21*b* (FIG. 3) for screw bolt 12 with a head has the shape of an eye ring, which in turn is configured by rolling in of one end segment of the cylindrical tubular body 23*b*.

Figure 3:
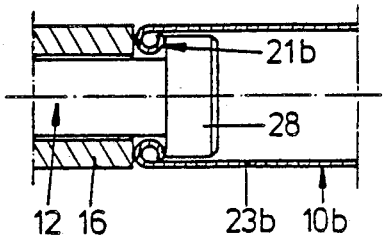
Figure 4:
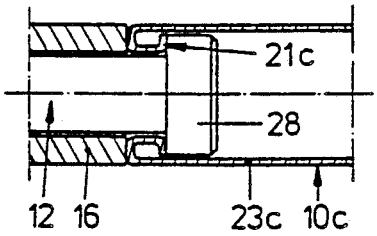

The limiting boss 21*c* for screw bolt 12 with a head shape corresponding to that shown in FIG. 4 likewise represents an eye ring, which however in this case, as opposed to FIG. 3, is of angular cross section.

Figure 5:
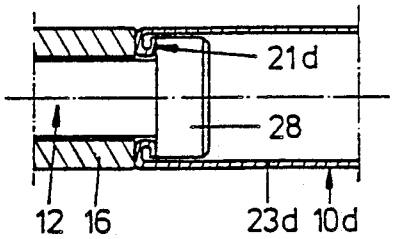

In FIG. 5, limiting boss 21*d* for screw bolt 12 with a head is shown wherein the eye ring is pressed flat as shown at 21*b* in FIG. 3.

Figure 6:
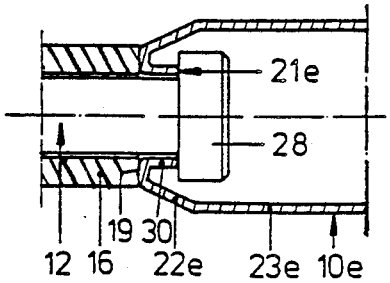
FIGS. 6 and 7 are partial elevational views in section similar to FIGS. 2–5, but showing different types of limiting bosses for the screw bolts with heads for different conically truncated tapered bar ends.
Figure 7:
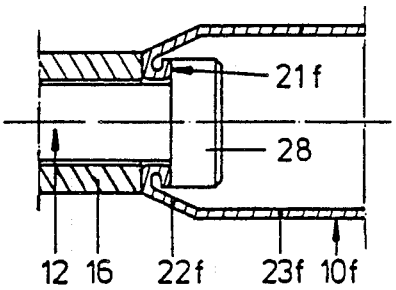

The limiting boss 21*e* shown in FIG. 6 for screw bolt 12 with a head is formed identical to the one shown in FIG. 2 from a collar 29 in the shape of a perforated disk together with a socket member 30 extending inside the bar. Collar 29 in the shape of a perforated disk in this modification, however, is at a right angle to the axis of the bar 10*e* and is formed by shaping the outside end of the tapered truncated conical end segment 22*e*. When the socket member 30 is widened somewhat at the inside end and is pressed against the collar 29 in the shape of a perforated disk, then the limiting boss 21*f* shown in FIG. 7 is obtained for screw bolt 12 with head.

Thus, all of the limiting bosses 21, 21*a* to 21*f* are formed by the shaping or molding of the respective end segments of tubular bars 10, 10*a* to 10*f* in their hollow spaces, and the bars can be cylindrical tubular bodies all the way through from one end to the other or else can be tubular bodies with conical end segments.

We claim:

1. Tubular framing bar assembly, comprising a tubular bar, an intersecting member having threaded boreholes, a screw bolt supported for rotatable and axial movement in the end area of the tubular bar, the screw bolt having a threaded segment at its outer end that is threadably received within a borehole of the intersecting member, and the screw bolt having a head at its inner portion that is engagable with an adjacent end portion of the tubular bar to limit its axial outer movement, characterized in that said end portion of the tubular bar (10) is an inwardly bent, substantially annular boss (21), said boss (21) comprising an end segment (24) of the bar (10) that is bent inwardly around an angle of approximately 180 degrees.

2. Framing bar assembly as in claim 1, characterized in that the boss (21, 21*e*, 21*f*) is formed on a generally truncated conical end segment (22, 22*e*, 22*f*) of the bar (10, 10*e*, 10*f*) which is formed integrally with the cylindrical tubular body (23, 23*e*, 23*f*) of the bar (10, 10*e*, 10*f*).

3. Framing bar assembly as in claim 1, characterized in that the boss (21*a*, 21*e*) has a collar (29) which is of perforated disk shape and which is at a right angle to the axis of the bar, and a socket member (30) extends from the collar (29) to the inside of the bar (10*a*, 10*e*).

4. Framing bar assembly as in claim 1, characterized in that the boss (21*b*) has the shape of a rolled-in eye ring.

5. Framing bar assembly as in claim 4, characterized in that the boss (21*c*) has the shape of an eye ring with an angular cross section.

6. Framing bar assembly as in claim 1, characterized in that the boss (21*d*, 21*f*) is formed of an eye ring which has been pressed flat.

7. Framing bar assembly as in claim 2, characterized in that the head (25) of the screw bolt (12) has the shape of a truncated cone with the outer surface (26) thereof engaging truncated conical bar end segment (22) to limit the outer movement of the screw bolt.

8. Framing bar assembly as in claim 2, characterized in that the boss (21*a*, 21*e*) has a collar (29) which is of perforated disk shape and which is at a right angle to the axis of the bar, and a socket member (30) extends from the collar (29) to the inside of the bar (10*a*, 10*e*).

9. Framing bar assembly as in claim 2, characterized in that the annular boss (21*b*) has the shape of a rolled-in eye ring.

10. Framing bar assembly as in claim 2, characterized in that the boss(21*d*, 21*f*) is formed of an eye ring which has been pressed flat.

11. Framing bar assembly as in claim 1, characterized in that a coupling sleeve (16) surrounds the portion of the screw bolt (12) between the intersecting member (11) and the end portion of the tubular bar (10), the coupling sleeve (16) being connected to the screw bolt (12) for rotation therewith, and the screw bolt (12) being axially movable relative to the coupling sleeve (16).

* * * * *